US010028626B2

(12) United States Patent
Harounian

(10) Patent No.: US 10,028,626 B2
(45) Date of Patent: Jul. 24, 2018

(54) ROLL HOLDER

(71) Applicant: Kaveh Harounian, Beverly Hills, CA (US)

(72) Inventor: Kaveh Harounian, Beverly Hills, CA (US)

( * ) Notice: Subject to any disclaimer, the term of this patent is extended or adjusted under 35 U.S.C. 154(b) by 261 days.

(21) Appl. No.: 14/994,978

(22) Filed: Jan. 13, 2016

(65) Prior Publication Data

US 2017/0196416 A1 Jul. 13, 2017

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01)

(58) Field of Classification Search
CPC ..... B65H 16/06; A47K 10/22; A47K 10/38; A47K 2010/3233
USPC ..... 242/598, 404.3, 598.5, 588, 406, 404
See application file for complete search history.

(56) References Cited

U.S. PATENT DOCUMENTS 6,305,035 B1 * 10/2001 Morris ..... A47K 10/40 242/588

FOREIGN PATENT DOCUMENTS

| | | | | |
|---|---|---|---|---|
| JP | 3157132 | U | | 1/2010 |
| KR | 10-2000-0012265 | A | | 3/2000 |
| KR | 20000012265 | A | * | 3/2000 |
| KR | 20-0187440 | Y1 | | 7/2000 |
| KR | 20-2010-0005174 | U | | 5/2010 |

OTHER PUBLICATIONS

Moddea, "Diabolo Toilet Roll Holder", [online], Apr. 29, 2013 [retrieved on Feb. 27, 2017]. Retrieved from the Internet: https://moddea.com/2013/04/29/diablo-toilet-roll-holder.

PCT Search Report and Written Opinion dated May 15, 2017 in connection with PCT/US2017/013339.

* cited by examiner

*Primary Examiner* — William E Dondero
(74) *Attorney, Agent, or Firm* — Berliner & Associates

(57) ABSTRACT

A holder for a roll of toilet paper or a roll of absorbent sheet material, the roll having a hollow cylindrical core, the holder comprising a patch formed of paper, cloth or thin plastic sheet, having an adhesive surface, cordage for insertion through the core secured to the patch. The assembly of the patch and cordage is capable of suspending the roll by adhesion of the patch to a surface. The cordage forms two legs which can be secured to the patch. Alternatively, one end of one leg of the cordage is fixed at a distal point below the patch to the other leg, the end of which is secured to the patch. The adhesive can be covered by a release sheet.

8 Claims, 10 Drawing Sheets

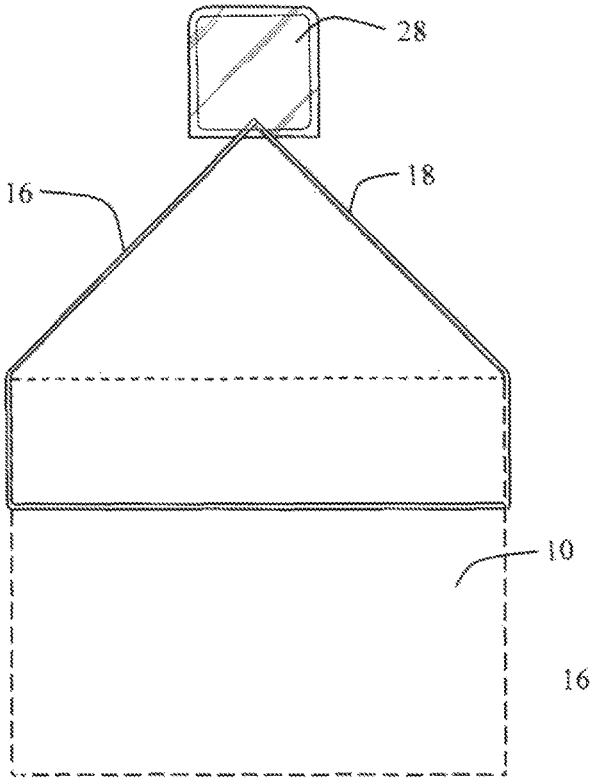
Fig. 3A
Fig. 3B
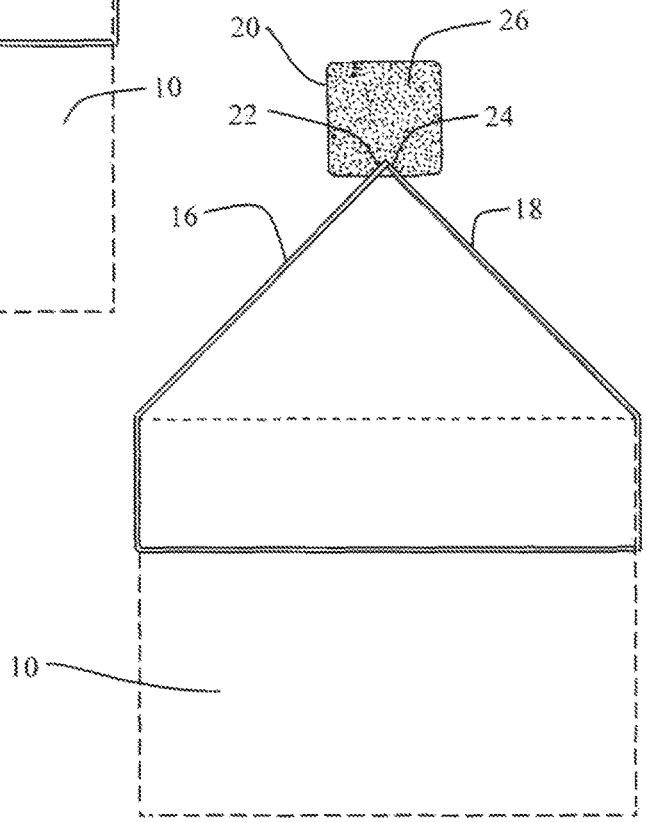

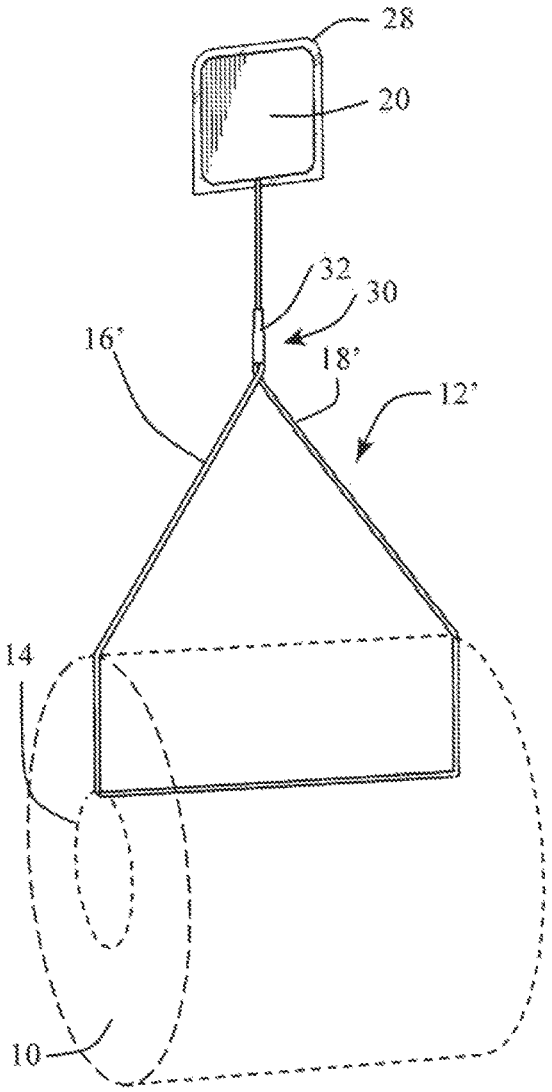
Fig. 8
Fig. 9
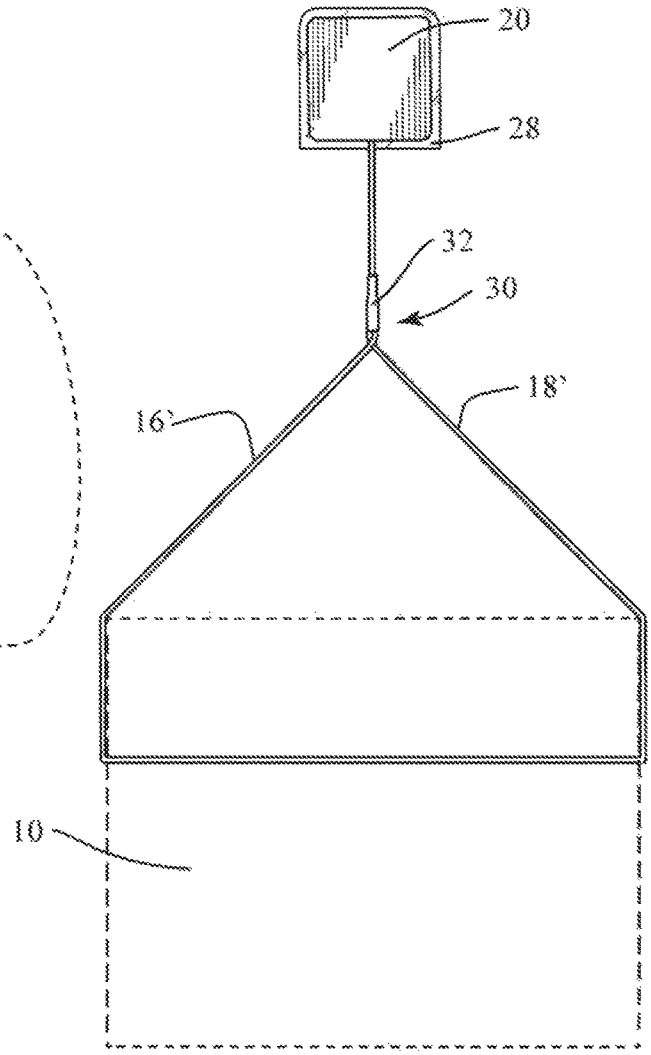

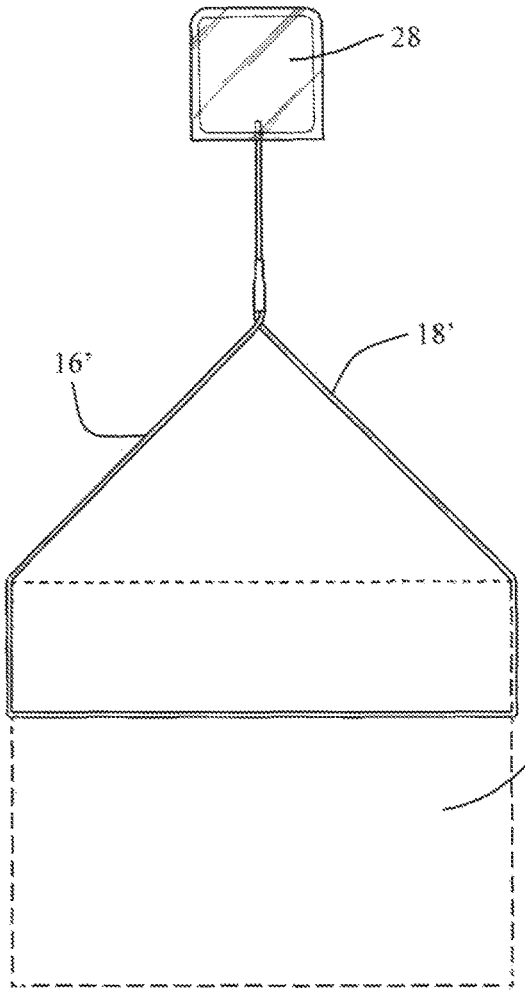
Fig. 10A
Fig. 10B
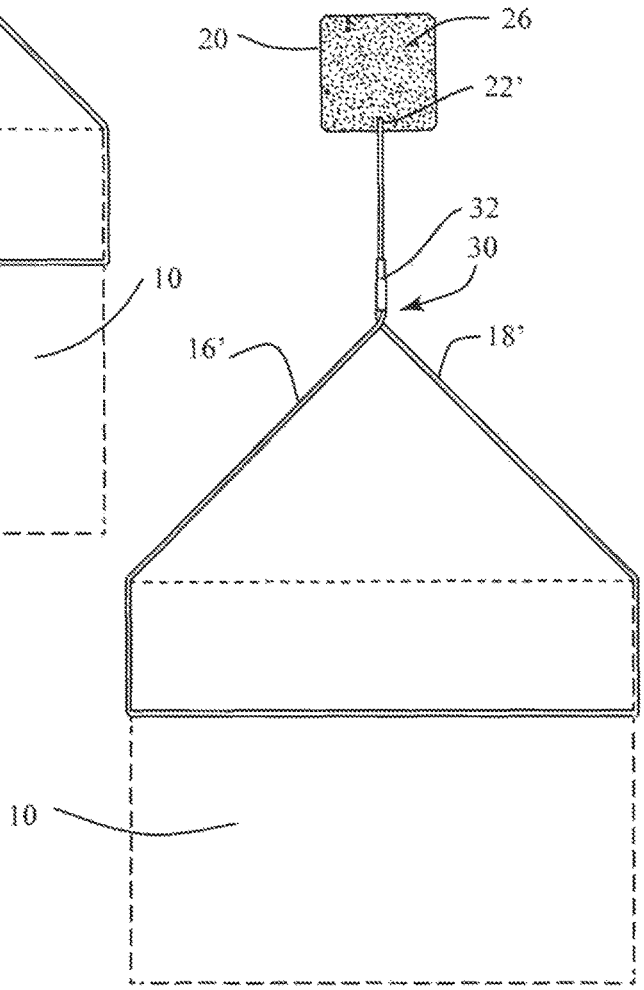

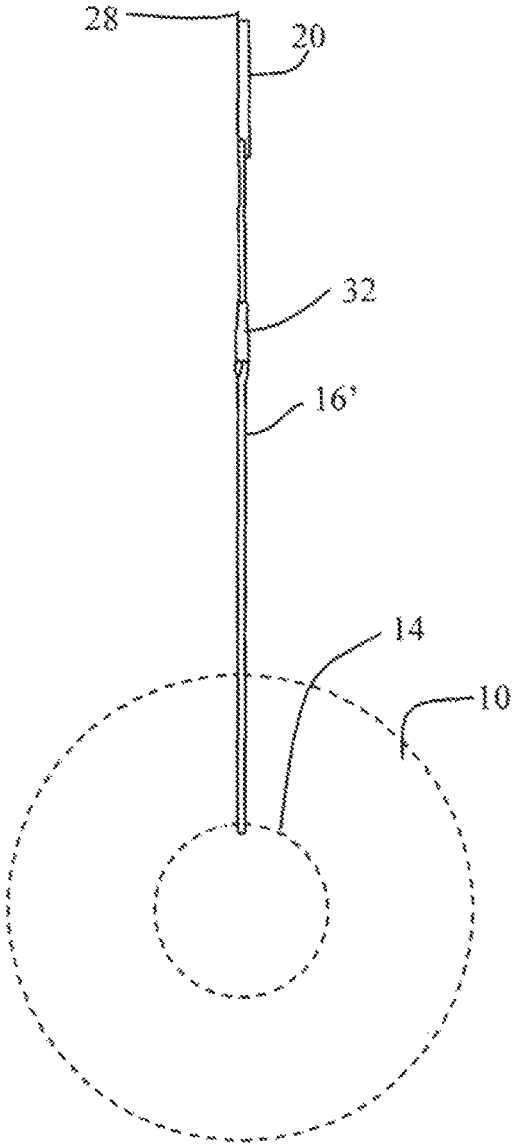
Fig. 11
Fig. 12
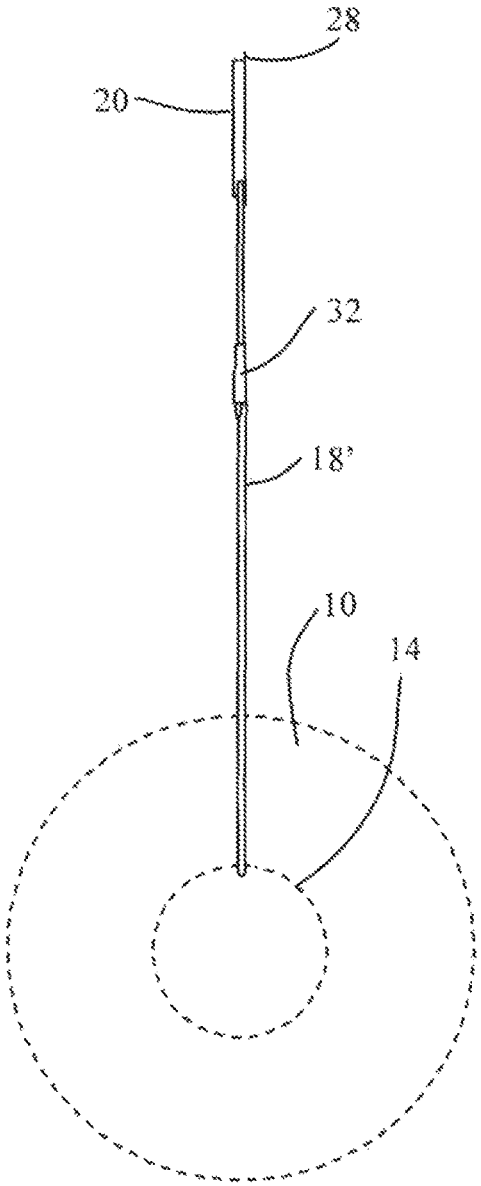

ROLL HOLDER

FIELD OF THE INVENTION

The invention relates to a roll holder such as for toilet paper or a roll of absorbent sheet material.

BACKGROUND OF THE INVENTION

A very wide variety of holders are known to facilitate the dispensing of roll paper such as toilet paper or a kitchen roll of paper or water-absorbent material. These include wall mounted devices and stand-alone devices. Wall mounted devices are connected to a wall and include spring loaded telescopic cores held between mounts that extend from a wall, and U-shaped metal rods that extend from a wall either horizontally or formed as an upright. Some of the holders are mainly functions while others are designer holders providing a bathroom or kitchen highlight for what otherwise would be a pedestrian device. A designer roll holder sold by Vandiss as the Diabolo Toilet Paper Holder (http://shop.gessato.com/diabolo-toilet-paper-holder-by-vandiss.html) uses a pulley mounted on a wall. Nautical rope is threaded through the hollow cylindrical core of a roll of toilet paper and is wrapped around the hub of the pulley to suspend the toilet paper. The toilet paper holder derives its mode of operation from the juggling toy that consists of a top in the form of a deep pulley balanced across a string. It is secured against the wall by use of adhesive applied to both the wall and to the back of the pulley, using heat such as from a hair blower followed by curing for 72 hours. A significant purpose of such a pulley holder is ornamental as are many of the various designer paper roll holders.

When a person needing the use of toilet paper or absorbent paper is not in a home having a bathroom or kitchen, for example when camping or when the person is homeless or living in meager or rundown housing, then the only recourse is to carry tissue paper or an unsupported paper roll. The use of a stand-alone device is not practical as it would be burdensome to carry such a device, and wall mounted devices of the prior art such as the afore-described pulley holder are not feasible. There is a need for a paper holder that can readily be mounted on the wall of a tent or on a wall that is too thin to support the usual holder or which cannot be drilled into, or even on a wall under an overpass that often serves as a shelter for homeless people. Such a holder must be simple and inexpensive yet must provide the convenience of a fully functional wall mounted paper roll holder.

BRIEF SUMMARY OF THE INVENTION

The present invention provides such a holder in the form of cordage that is inserted through the hollow cylindrical core of a roll of toilet paper or roll of absorbent sheet material forming two legs and suspended from a wall by means of an adhesive patch to which the cordage is fixed. In one embodiment, the two legs of the cordage can be joined at their ends and at its juncture secured to the patch. In another embodiment, one end of one leg of the cordage is fixed at a distal point below the patch to the other leg, the end of which is secured to the patch. Fixing can be by knotting or by fusion and can be overlaid within a plastic sleeve. The cord constituting the cordage can be formed of string, cable, braiding such as braided thread, lace, lanyard, or twine. It can be a single cord or be formed of multiple cords. The cordage can be secured to the patch by the adhesive of the patch or can be sewn to the patch. The patch is a piece of material of any convenient shape, square, triangular, circular or the like formed of paper, cloth or thin (i.e., less than 0.3 cm thick) plastic sheet. It has adhesive on a side which can be covered by a paper, cloth or thin plastic release sheet which can be opaque or clear, and may carry printing on its outer side. Such printing can be a design or text or a combination thereof and can be a logographic for the company manufacturing the holder or a third party to generate advertising revenue. The holder can be provided independent of the roll it is to support, or it can be provided already inserted through the core of the roll with the ends of the cordage secured.

BRIEF DESCRIPTION OF THE DRAWINGS

For a more complete understanding of the present invention, reference is now made to the following descriptions taken in conjunction with the accompanying drawing, in which the broken lines are for the purpose of illustrating a roll of paper carried by the holder and in which:

FIG. 3A is a rear plan view of the embodiment of FIG. 1, showing a clear plastic release sheet carried on an adhesive layer;

FIG. 3B is a rear plan view of the embodiment of FIG. 3A with the clear plastic release sheet removed exposing the adhesive layer;

FIG. 8 is a front perspective view of a second embodiment of the invention;

FIG. 9 is a front plan view of the embodiment of FIG. 8;

FIG. 10A is a rear plan view of the embodiment of FIG. 8, showing a clear plastic release sheet carried on an adhesive layer;

FIG. 10B is a rear plan view of the embodiment of FIG. 10A with the clear plastic release sheet removed exposing the adhesive layer;

FIG. 11 is a left side view of the embodiment of FIG. 8;

FIG. 12 is a right side view of the embodiment of FIG. 8;

DETAILED DESCRIPTION OF THE INVENTION

Figure 1:
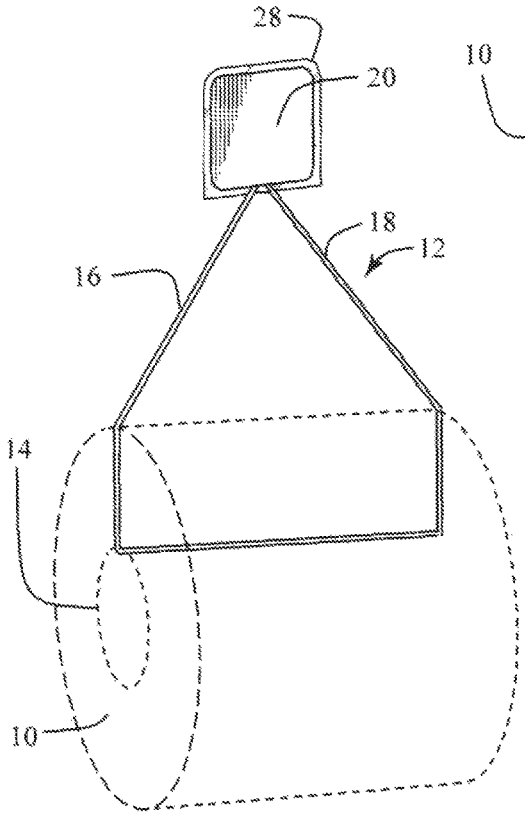
FIG. 1 is a front perspective view of a first embodiment of the invention.
Figure 2:
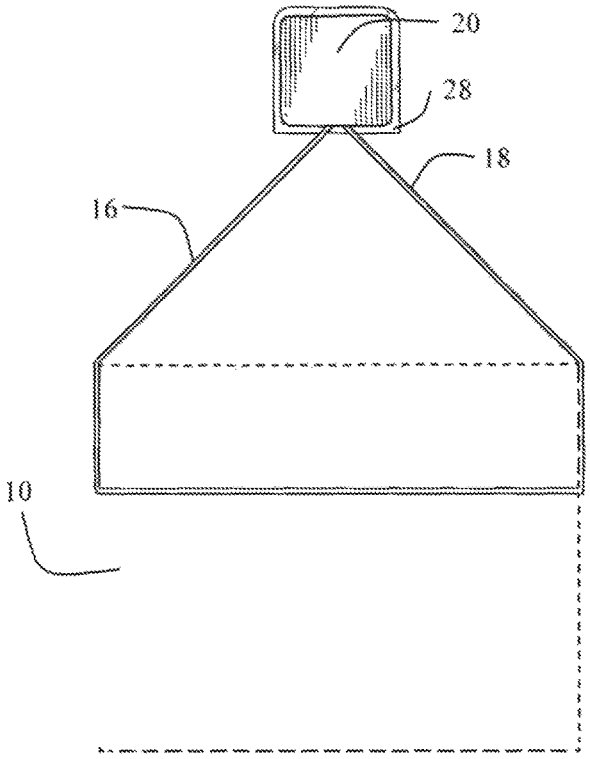
FIG. 2 is a front plan view of the embodiment of FIG. 1.
Figure 4:
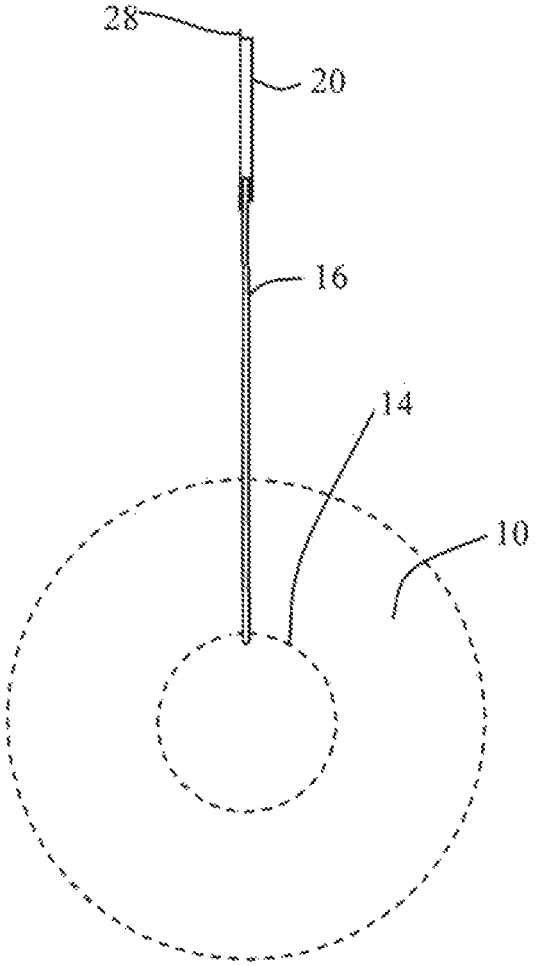
FIG. 4 is a left side view of the embodiment of FIG. 1.
Figure 5:
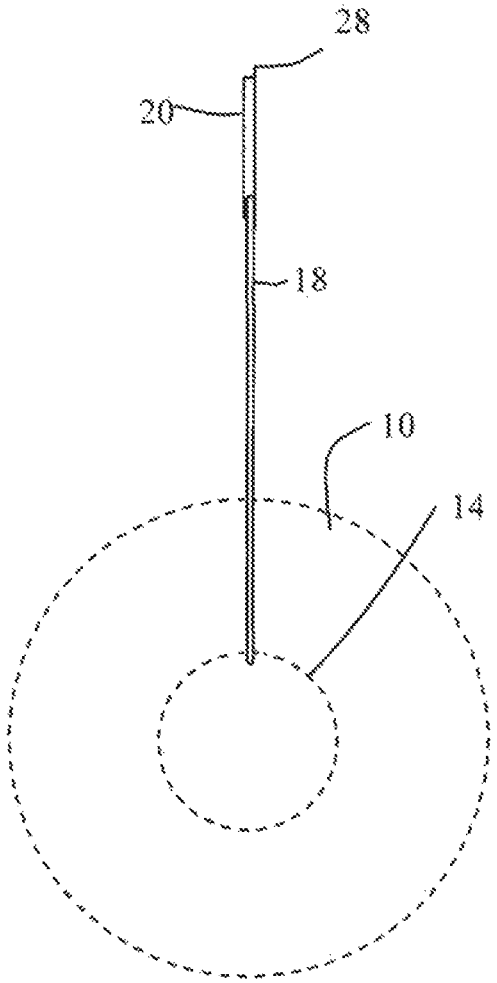
FIG. 5 is a right side view of the embodiment of FIG. 1.
Figure 6:
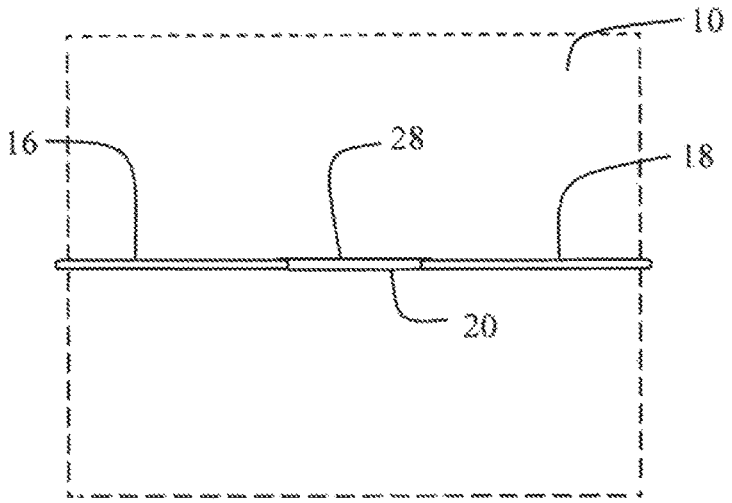
FIG. 6 is a top view of the embodiment of FIG. 1.
Figure 7:
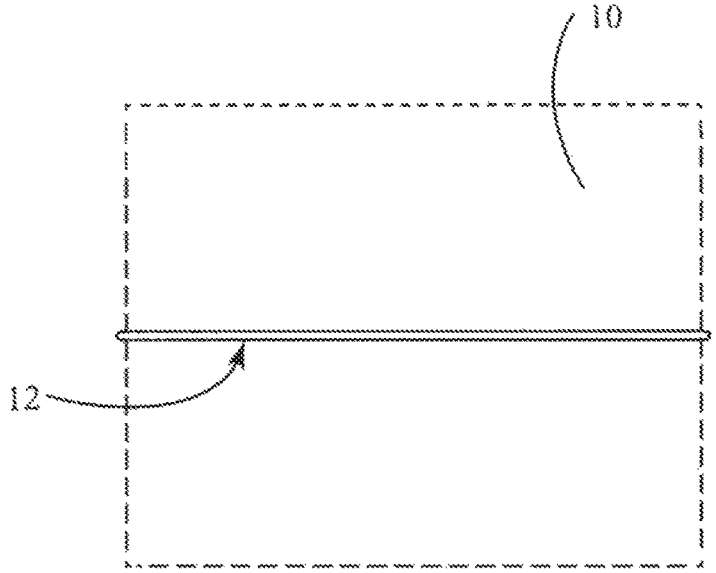
FIG. 7 is a bottom view of the embodiment of FIG. 1.
Figure 13:
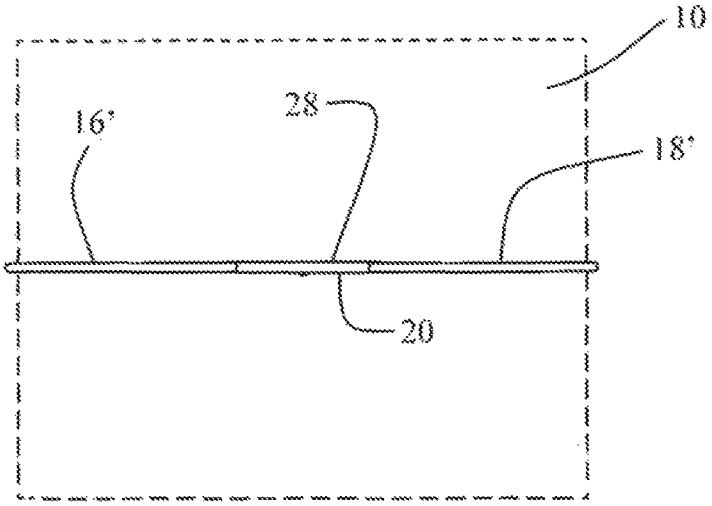
FIG. 13 is a top view of the embodiment of FIG. 8.
Figure 14:
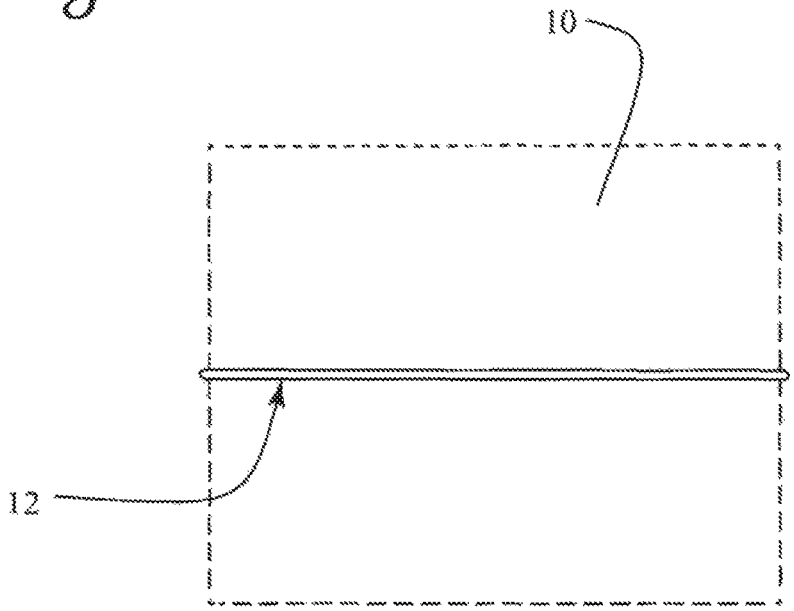
FIG. 14 is a bottom view of the embodiment of FIG. 8.
Figure 15A:
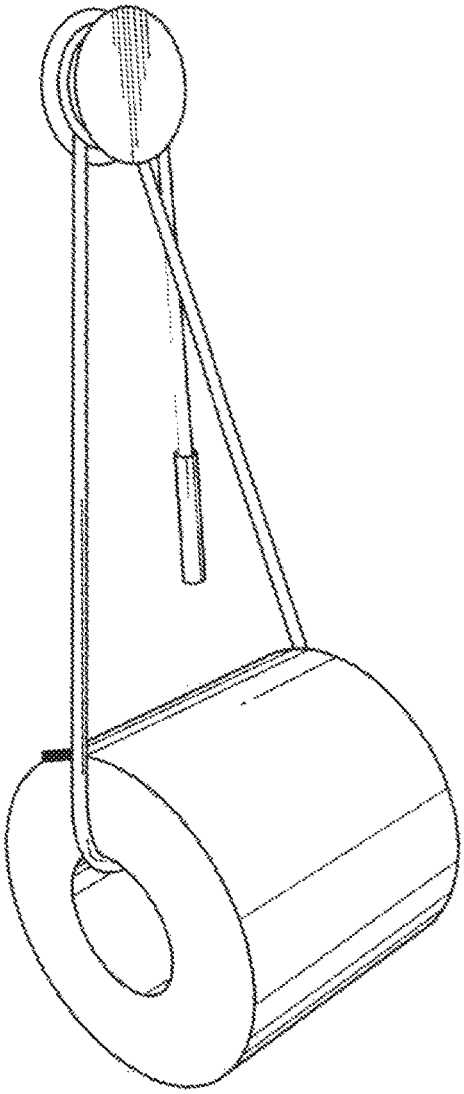
Fig. 15A Prior Art
FIG. 15A depicts a prior art holder designed to mount a pulley onto a wall with a nautical rope threaded through the hollow cylindrical core of a roll of toilet paper and wrapped around the hub of the pulley to suspend the toilet paper.
Figure 15B:
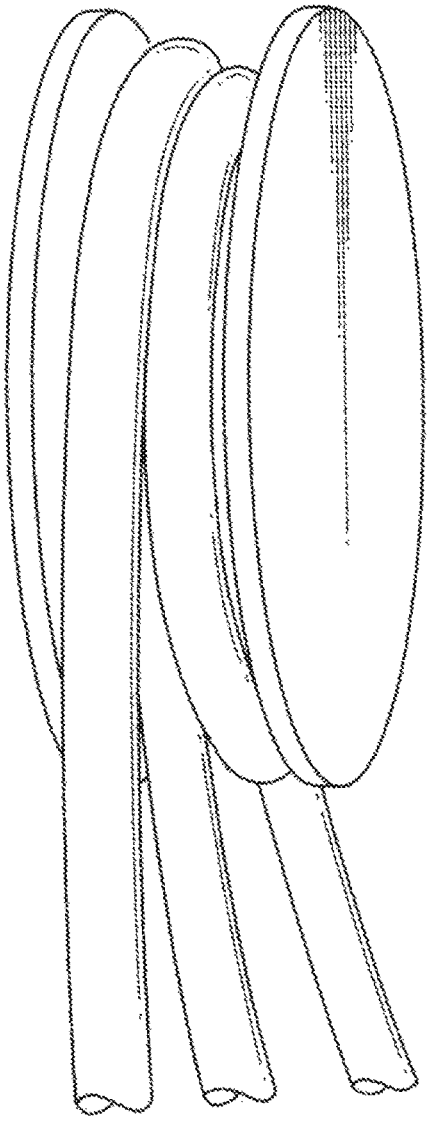
Fig. 15B Prior Art
FIG. 15B depicts a close-up of the pulley region of the holder of FIG. 15A.
Figure 15C:
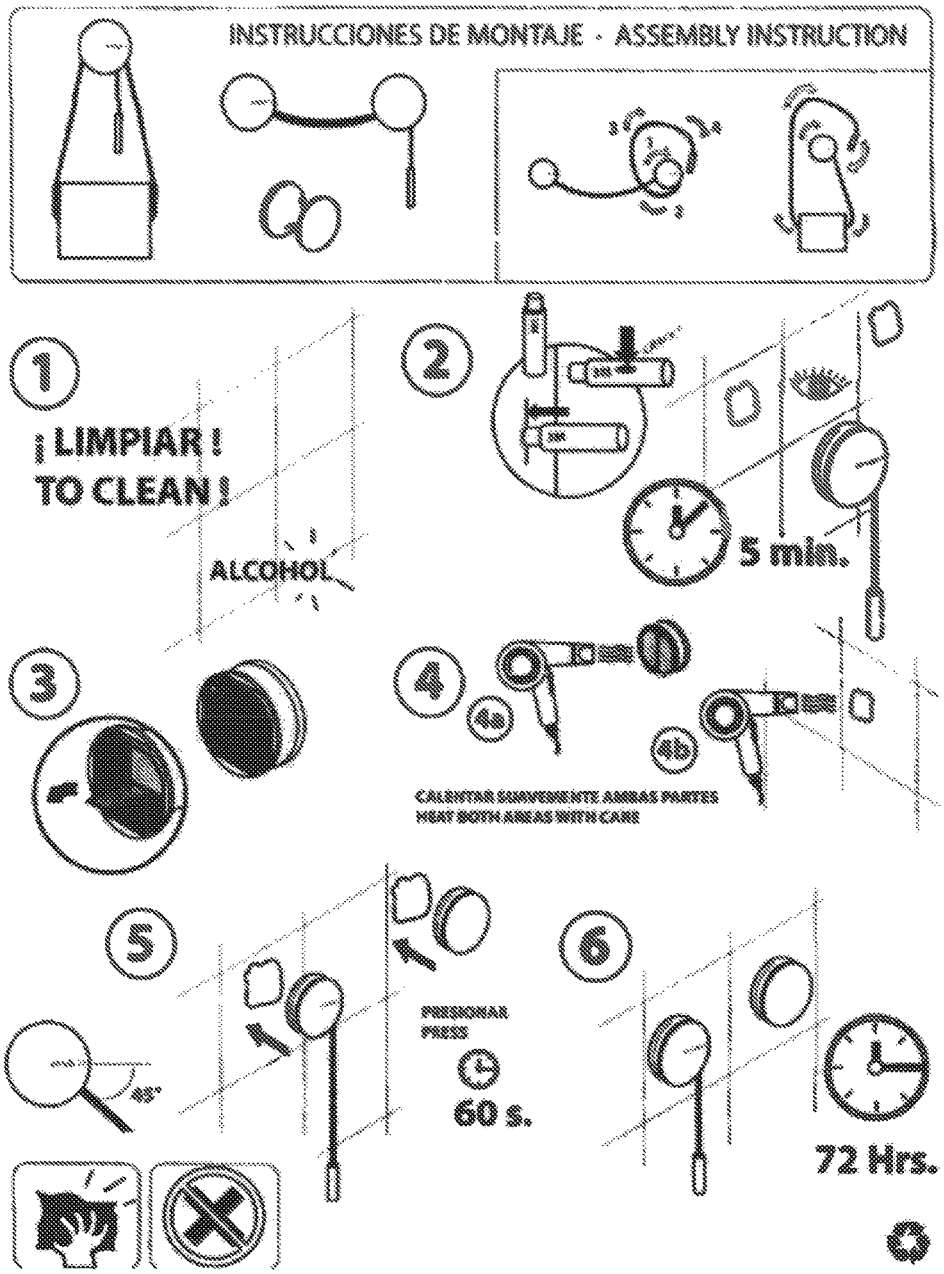
Fig. 15C Prior Art
FIG. 15C is the instruction sheet for the holder of FIG. 15A.

FIGS. 15A-C depict a designer roll holder, and its instruction sheet, sold by Vandiss as the Diabolo Toilet Paper Holder (http://shop.gessato.com/diabolo-toilet-paper-holder-by-vandiss.html) that suspends a roll of toilet paper on a length of nautical rope that is threaded through the hollow cylindrical core of a roll of toilet paper and is wrapped around the hub of a pulley to suspend the toilet paper. The pulley is mounted on a wall using adhesive applied to both the wall and to the back of the pulley.

Because of the weight of the pulley added to the weight of the roll, mounting requires using heat such as from a hair blower followed by curing for 72 hours.

FIGS. 1-7 depict a first embodiment of the invention in which a roll of paper, illustrated by a roll of toilet paper 10 is suspended by cordage 12. The cordage 12 is inserted through the hollow cylindrical core 14 of the roll of toilet paper or roll of absorbent sheet material forming two legs 16, 18 but rather than being wound about a pulley or other device that needs to be fixed with hardware to a wall the present invention utilizes an adhesive patch 20 to which the ends 22, 24 of the cordage 12 are secured, as shown in FIG. 3B and to secure the cordage 12 to a wall or other support.

The patch 20 is a piece of material of any convenient shape, square, triangular, circular or the like formed of paper, cloth or thin (i.e., less than 0.3 cm thick) plastic sheet, having adhesive 26 on a side as shown in FIG. 3B. The adhesive 26 can be covered by a release sheet 28, which can be opaque or clear, and may carry printing on its outer side. Such printing can be a design or text or a combination thereof and can be a logographic for the company manufacturing the holder or a third party to generate advertising revenue. The release sheet 28 can be of clear plastic, as shown, of paper or other material. As shown, in FIG. 3B, the ends of the cordage 22, 24 can be fixed to the patch 20 by the adhesive 26. Alternatively, or in addition, the ends 22, 24 of the cordage can be sewn to the patch 20 or, it the cordage 12 and patch 20 are of plastic material they can be fused together.

Referring to FIG. 8-14, a second embodiment is depleted wherein one end of one leg 16' of the cordage 12' is fixed to the other leg 18' at a distal point 30 below the patch 20, the end 22' of the leg 16' being secured to the patch 20. Fixing can be by knotting or by fusion and can be overlaid within a plastic sleeve 32.

The cordage 12 or 12' can be formed of string, cable, braiding such as braided thread, lace, lanyard, twine, of cord or any other suitable material.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

The invention claimed is:

1. A holder for a roll of toilet paper or a roll of absorbent sheet material, the holder being constructed to have one side mountable directly to a surface of a wall, the roll having a hollow cylindrical core, the holder comprising a patch, having an adhesive surface covered by a release sheet on said side and string or rope cord capable of being inserted through the roll core and directly secured to the adhesive surface of the patch, the assembly of the patch and cord being capable of supporting the roll suspended by the string or rope by adhesion of the patch directly to said wall surface, the patch consisting essentially of paper, cloth or thin plastic sheet.

2. The holder of claim 1 wherein the cord comprises a single cord with two legs for extending from the supported roll.

3. The holder of claim 2 wherein each leg is secured at its end to the patch.

4. The holder of claim 2 wherein one end of one leg of the cord is fixed at a distal point below the patch to the other leg, the end of which is secured to the patch.

5. An assembly of a roll of toilet paper or a roll of absorbent sheet material and a holder for the roll, the holder being constructed to have one side mountable to a surface of a wall, the roll having a hollow cylindrical core, the holder comprising a patch having an adhesive surface covered by a release sheet on said side and string or rope cord capable of being inserted through the core and directly secured to the adhesive surface of the patch, the assembly of the patch and cord being capable of supporting the roll suspended by the string or rope by adhesion of the patch directly to said wall surface, the patch consisting essentially of paper, cloth or thin plastic sheet.

6. The assembly of claim 5 wherein the cord comprises a single cord with two legs for extending from the supported roll.

7. The assembly of claim 6 wherein each leg is secured at its end to the patch.

8. The assembly of claim 6 wherein one end of one leg of the cord is fixed at a distal point below the patch to the other leg, the end of which is secured to the patch.

* * * * *